United States Patent [19]

Clower

[11] 4,453,632

[45] Jun. 12, 1984

[54] PROTECTIVE COVER FOR GOLF CLUBS

[76] Inventor: William J. Clower, P.O. Box 1128, Amelia Island, Fla. 32034

[21] Appl. No.: 545,922

[22] Filed: Oct. 27, 1983

[51] Int. Cl.[3] ..... A63B 55/00

[52] U.S. Cl. ..... 206/315.4; 150/52 G

[58] Field of Search ..... 150/52 G; 206/315.3, 206/315.4

[56] References Cited

U.S. PATENT DOCUMENTS 1,899,825 2/1933 Reach ..... 206/315.4

3,913,648 10/1975 Sessler ..... 150/52 G X

*Primary Examiner*—William Price

*Assistant Examiner*—Sue A. Weaver

*Attorney, Agent, or Firm*—Earl L. Tyner

[57] ABSTRACT

A flexible plastic sheet generally circular in shape and having a plurality of weights spaced around its periphery and having a reinforcing tab at the periphery for releaseably attaching the cover to the shoulder strap supporting ring of the golf bag. The cover is used to protect the golf clubs from rain.

9 Claims, 4 Drawing Figures

PROTECTIVE COVER FOR GOLF CLUBS

BACKGROUND OF THE INVENTION

Golf clubs must be kept dry in order for the golfer to be able to grip the clubs properly without slippage, and in order to keep the finish on the clubs from deteriorating and to prevent rust and corrosion from occurring. Golf bags normally include a bag cover which attaches to the top of the bag and covers the club heads for shipping, and which may also be used for rain protection. These covers, however, are opaque and fit closely over the clubs, and therefore, are not convenient to use, if one wishes to play golf in the rain. Plastic trash bags are frequently carried in the golf bag for use during rain, but they are fragile and not convenient to use because each time a golf club is removed from the golf bag or replaced, the plastic bag must be completely removed from the clubs.

It is an object of this invention to provide an improved golf club cover. It is another object of this invention to provide a transparent sheet that may be draped over the clubs in a golf bag and remain in place while clubs are easily removed from or replaced in the golf bag. Still other objects will appear from the more detailed description which follows:

BRIEF DESCRIPTION OF THE INVENTION

This invention relates to a protective cover for golf clubs in a golf bag having a shoulder strap supporting ring at the top of the bag, which comprises a flat, flexible, plastic sheet having weights attached thereto and distributed around the periphery thereof, and a ring attachment tab attached to the sheet at its periphery and having a slit adapted to receive the shoulder strap supporting ring therethrough with a tongue to cover said slit to inhibit the ring from being withdrawn from the slit, and also to keep rain from entering the golf bag through the slit, especially when the bag is being carried by a caddy.

In specific embodiments of this invention the plastic cover is transparent and has two parallel flexible rod-like members cemented to the inside surface of the cover to engage the golf clubs and to inhibit sidewise movement of the cover.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
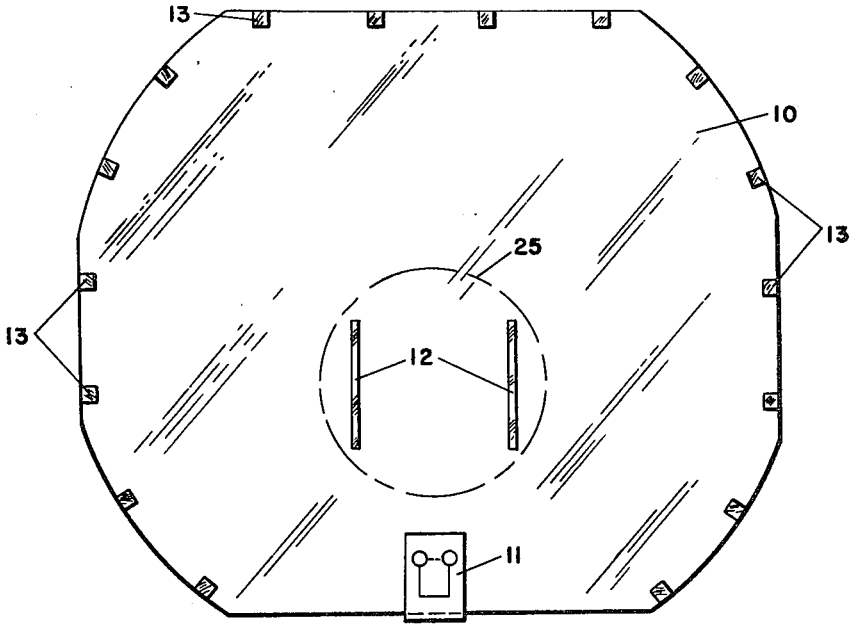
FIG. 1 is a top plan view of the golf club cover of this invention.
Figure 2:
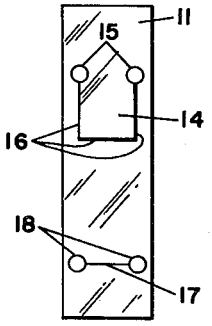
FIG. 2 is a top plan view of the ring attachment tab on the cover of this invention.

In FIGS. 1 and 2 there is shown the golf club cover of this invention. Cover 10 is a flat sheet of flexible plastic, preferably transparent. The material may be a polyolefin, such as polyethylene or polypropylene, polyester, polyvinyl, polycarbonate, polyamide, or the like. Any film or sheet material that is reasonably tough, and transparent is suitable for this cover. The shape of the cover is generally circular, by which is meant that it may be circular, polygonal, or some similar shape approaching circular. A suitable size is about 30–45 inches in diameter and a thickness of 2–6 mils (0.002–0.006inch).

Around the periphery of cover 10 are distributed a plurality of small weights 13, e.g. ½ ounce each, that are attached to cover 10 by any convenient means. For example, the weights may be cemented, heat sealed, or pressure stamped onto cover 10, or alternatively a hem may be fashioned around cover 10 and the weights placed in the hem in a spaced relationship. These weights are employed to hold the cover over the clubs in a draped position, even though the weather may be windy. Preferably the weights are substantially evenly spaced around the periphery although other designs may be employed in certain embodiments of this invention. For example, it is not necessary to employ weights in the cover near the ring attachment tab because cover 10 in this area will be attached to the golf bag at the ring rather than hanging free. In some instances it may be preferred that weights 13 may be magnetic, particularly if the structure of the golf bag and/or the golf clubs will provide magnetic attraction to the weights. If cover 10 is about 30–45 inches in diameter there may be about 10–24 one-half ounce weights employed and spaced about 5–10 inches apart around most of the periphery.

At some point around the periphery of cover 10, preferably where there are no weights 13 nearby, is a ring attachment tab 11. The purpose of tab 11 is to attach cover 10 to golf bag 19 by the shoulder strap supporting ring 20. Tab 11 preferably, is a strip of the same type of plastic sheet as cover 10, although it may be made of tougher material which can be firmly attached to cover 10 as by cementing, riveting, welding, etc. Tab 11 has a slit 17 and a flap 14 made by cutting the material of tab 11 along a line for slit 17, and along three lines 16 to form flap 14. In order to minimize the possibility of flap 14 or slit 17 from tearing beyond its designed extremities, it is preferred that the cut lines terminate in punched holes as at 15 and 18. When tab 11 is attached properly to cover 10, it will provide a reinforced area where ring 20 may be passed partially through slit 17 and held in place by flap 14 as will be described in more detail below.

An optional feature shown in these drawings comprises two guide members 12, which are attached to the underneath side of cover 10 for the purpose of preventing cover 10 from sliding sidewise. Members 12 are preferably made of flexible foamed plastic, rubber or other elastomeric material. Guide members 12 are long narrow rod-like structures which are cemented or otherwise attached to the underneath surface of cover 10, and are spaced apart, generally parallel to each other, so as to be positioned at the outside of the golf clubs in which cover 10 rests. The downward projections of members 12 will be sufficient to prevent a sidewise slippage of cover 10 and help to keep it centered over bag 19 as shown by phantom line 25 in FIG. 1. A suitable size for guide members 12 is about $\frac{1}{4}\times\frac{3}{8}\times 8$ inches.

Figure 4:
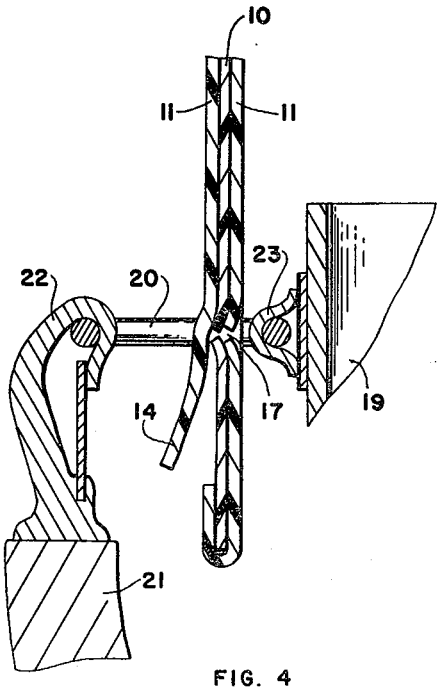
FIG. 4 is a cross-sectional view taken at 4—4 of FIG. 3.

In FIG. 4 there is shown an enlarged cross-section of tab 11 joined to cover 10 and how it is attached to the golf bag. Golf bag 19 has near its top, an eye 23 affixed to bag 19 and serving as an attachment for ring 20. The purpose of ring 20 is to permit attachment of the upper end of shoulder strap 21 by means of snap hook 22. This is also a convenient point for attachment of cover 10 when needed. Cover 10 is sufficiently thin and flexible that it can be folded into a small package, and when not used, can be carried in one of the pockets built into golf back 19. When it starts to rain the folded cover 10 is quickly removed from the pocket and attached to bag 19 at ring 20 by unsnapping hook 22, pushing ring 20 through slit 17, and reattaching hook 22 to ring 29. Tab 11 is laminated cover 10 so that holes 15 and 18 are aligned. This is preferably done by sandwiching cover 10 between the two ends of tab 11 which is doubled back over an edge of cover 10. Slit 17 is cut through tab 11 and also through cover 10 so that ring 20 may be pushed through those two layers of plastic sheet. The outer layer contains flap 14 which is merely pushed upward when ring 20 is passed through slits 17. Flap 14 is then threaded downwardly through ring 20 (as shown in FIG. 4) and serves as a check valve to prevent cover 10 and tab 11 from sliding off ring 20 when hook 22 is not attached, or from sliding onto hook 22 when it is attached; and also to prevent rain leakage into the bag.

It should be apparent that tab 11 need not be attached as shown. Tab 11 could be folded and both layers attached to the outside of cover 11 rather than to sandwich cover 10 between these layers. Furthermore, an alternative embodiment might employ only the upper half of tab 11 (as seen in FIG. 2) to provide flap 14, while slit 17 is cut in cover 10. These alternative embodiments are operable but not preferred. The construction shown in FIG. 4 is best because it provides the most reinforcement in the area that receives the most stress.

Figure 3:
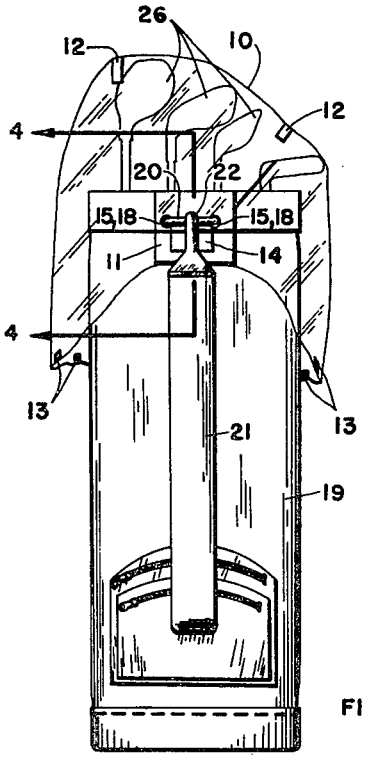
FIG. 3 is a front elevational view of a golf bag and golf clubs with the cover of this invention attached thereto.

In FIG. 3 there is shown the cover to this invention as it would be used on a golf bag. Bag 19 with an assortment of clubs 26 has a shoulder strap 21 attached to ring 20 by means of snap hook 22. When required, cover 10 is attached to ring 20 as described above and cover 10 is then spread over the exposed heads of clubs 26 and the edges allowed to drape downwardly, and held in that position by weights 13. Ring 20 is shown aligned with holes 15 and 18 (which are aligned with slit 17, not shown). When cover 10 is draped over clubs 26 guide members 12 will catch the sides or edges of one or more of clubs 26 and prevent cover 10 from falling off clubs 26 by sidewise motion. Whenever one of clubs 26 is selected to be removed from bag 19 or to be replaced into bag 19, cover 10 is merely lifted momenetarily for the removal or replacement of club 26 and then allowed to drop back in place draped over the clubs.

While the invention has been described with respect to certain specific embodiments, it will be appreciated that many modifications and changes may be made by those skilled in the art without departing from the spirit of the invention. It is intended, therefore, by the appended claims to cover all of such modifications and changes as fall within the true spirit and scope of the invention.

What is claimed as new and what is desired to secure by Letters Patent of the United States is:

1. A protective cover for golf clubs in a golf bag having a shoulder strap supporting ring at the top of the bag, which comprises a flat flexible plastic sheet having weights attached thereto around the periphery thereof, and a tab attached to the sheet at an edge thereof and having a slit adapted to receive the shoulder strap supporting ring therethrough with a tongue to cover said slit to inhibit the ring from being withdrawn from the slit.

2. The cover of claim 1 which additionally comprises two spaced generally parallel guide members attached to and projecting downwardly from the underneath side of the sheet and adapted to prevent sidewise slippage of the sheet when draped over the heads of golf clubs in the golf bag.

3. The cover of claim 2 wherein said guide members are flexible foamed elastomeric rods.

4. The cover of claim 1 wherein said tab is a doubled-over strip of flat flexible plastic sheet laminated to said cover and having a horizontal slit through one layer of said strip and through said cover, and having a tongue cut in said strip, the base of the tongue corresponding to and registered with said slit, and the free end of the tongue hanging downwardly.

5. The cover of claim 1 wherein said cover has attached thereto a plurality of small weights spaced substantially equally around the periphery of the cover.

6. The cover of claim 1 wherein said cover is substantially circular in shape.

7. The cover of claim 1 wherein said plastic sheet is generally transparent.

8. A protective transparent cover for golf clubs in a golf bag having a shoulder strap supporting ring adjacent the top of the bag, the cover comprising a flat flexible transparent plastic sheet generally circular in shape and having an outside surface and an inside surface, a plurality of spaced weights distributed around the periphery thereof, and a reinforcing tab for attaching the cover to the supporting ring of the golf bag, said tab comprising a strip of plastic sheet folded and cemented to both sides of said cover at the periphery thereof to form a three-layer structure, a horizontal slit through the center and inside layers of said structure adapted to pass said ring therethrough, and a tongue flap formed by slits in the outer layer of said structure with the root of the tongue located adjacent the horizontal slit and the free end of the tongue depending downwardly therefrom and adapted to be threaded through said ring.

9. The cover of claim 8 which additionally comprises two generally parallel spaced rod-like strips of elastomeric foam material cemented to the inside surface of said cover in the central portion thereof and adapted to engage the outside golf clubs in the bag and inhibit the cover from sliding sidewise.

* * * * *